US007176369B1

(12) United States Patent
Brooks

(10) Patent No.: US 7,176,369 B1
(45) Date of Patent: Feb. 13, 2007

(54) ERGONOMIC RINGS FOR DRUM STICKS, METHOD OF INSTALLATION, AND METHOD OF USE

(76) Inventor: Robert C. Brooks, 4890 Merwin Ave., DeLeon Springs, FL (US) 32130

( * ) Notice: Subject to any disclaimer, the term of this patent is extended or adjusted under 35 U.S.C. 154(b) by 188 days.

(21) Appl. No.: 10/943,820

(22) Filed: Sep. 17, 2004

(51) Int. Cl.
*G10D 13/02* (2006.01)

(52) U.S. Cl. ..... 84/422.4; D17/99; D17/22

(58) Field of Classification Search ..... 84/422.4, 84/422.2; D17/99, 22
See application file for complete search history.

(56) References Cited

U.S. PATENT DOCUMENTS

| | | | | |
|---|---|---|---|---|
| 1,953,619 | A | 4/1934 | Ludwig | |
| 2,905,043 | A | 9/1959 | Soderberg | |
| 3,137,194 | A | 6/1964 | Simpson, Jr. | |
| 3,365,108 | A | 1/1968 | Giba | |
| 4,488,470 | A | 12/1984 | Larrain | |
| 4,535,671 | A | 8/1985 | Stromberg et al. | |
| D295,872 | S | 5/1988 | Koumarianos | |
| 5,179,237 | A | 1/1993 | Grossman | |
| 5,260,506 | A | 11/1993 | Cappella | |
| 5,361,671 | A | 11/1994 | Genna | |
| 5,370,030 | A | 12/1994 | Horne | |
| 5,400,685 | A | 3/1995 | Cappella | |
| 5,581,031 | A | 12/1996 | Blankenship, Jr. | |
| 6,118,062 | A | 9/2000 | Thoman | |
| 6,310,278 | B1 | 10/2001 | Butler | |
| 2004/0025666 | A1* | 2/2004 | Mizuno et al. | 84/422.4 |
| 2006/0027073 | A1* | 2/2006 | Richard | 84/422.4 |
| 2006/0090629 | A1* | 5/2006 | Nybye | 84/422.4 |

* cited by examiner

*Primary Examiner*—Gary F. Paumen
(74) *Attorney, Agent, or Firm*—Paul S. Rooy, P.A.

(57) ABSTRACT

Ergonomic rings for drum stick, method of installation, and method of use. A pair of resilient rings is installed on a drum stick spaced apart substantially by a distance equal to the width of a drummer's middle finger. The ergonomic rings have the effect of increasing drum stick radius, thereby substantially reducing the amount of force the drummer must expend to play the drum stick, reducing drummer fatigue, and increasing drummer speed. In addition, the rings aid in ensuring that the drummer's hand is disposed in the correct location along the length of the drum stick, and in preventing the drum stick from slipping out of the drummer's hand during play. Methods of installation and use are also disclosed.

2 Claims, 8 Drawing Sheets

ERGONOMIC RINGS FOR DRUM STICKS, METHOD OF INSTALLATION, AND METHOD OF USE

BACKGROUND OF THE INVENTION

1. Field of the Invention

This invention relates to drum sticks, and in particular to ergonomic rings for drum sticks, method of installation, and method of use.

2. Background of the Invention

Drums are one of the most important percussion instruments. These may be played by hand, or drum sticks may be used.

FIG. 1 depicts a typical prior art drum stick 2 comprising shaft 4 terminating in bead 6. Drum stick 2 is employed to play a drum by holding its shaft 4, usually either in the traditional or match-grip style.

A number of problems exist with prior art drum sticks. One problem especially pronounced in the case of beginners is holding shaft 4 in the correct location along its length. Another problem is the inherent slippery nature of the polished wood from which traditional drum sticks are manufactured. This problem becomes especially severe where the drummer is perspiring while playing. In this case, the drummer must expend precious energy to tightly grip the drum sticks to avoid having them fly out of his hands.

Still another problem associated with traditional drum sticks is the force required to be exerted by the drummer merely to play the drums: because of the small diameter inherent in the design of traditional drum sticks, the moment generated by the drummer is small in direct proportion to the small drum stick diameter. Thus, it would be desirable to provide ergonomic rings for drum sticks which increase the moment arm available to the drummer, thus reducing the force required by the drummer to play the drums.

Existing Designs

U.S. Pat. Nos. Des. 295,872 and 3,137,194 were granted to Koumarianos and Simpson, Jr. respectively. Koumarianos '872 taught a slip-on grip having two series of integral rings spaced apart by approximately the width of the drummer's hand. While this design helped prevent the drum stick from slipping out of the drummer's hand, the distance between the two ring series was fixed, and thus was not adjustable for the finger size of the individual drummer. In addition, the spacing between the two ring series was approximately equal to the width of the drummer's hand, which is too great a distance for use with the instant method, which relies on rings spaced apart by a distance substantially equal to the width of a drummer's middle finger.

The Simpson '194 design taught two rings which were also spaced apart approximately the width of the drummer's hand. As in the Koumarianos '872 design, the Simpson design helped prevent the drum stick from slipping out of the drummer's hand. However, the distance between the two rings was approximately equal to the width of the drummer's hand, which is too great a distance for use with the instant method. In addition, the position of the rings on the drum shaft was limited by the location of existing grooves and pre-drilled holes into which the rings were intended to fit. Thus, the Simpson '194 rings were not infinitely adjustable along the length of the drum stick shaft, thus negatively affecting their adjustability to individual drummer preference. Finally, the Simpson '194 rings were taught to be spiral constructions, rather than rings made of resilient material, thus increasing their complexity and consequently their cost.

U.S. Pat. Nos. 6,310,278, 6,118,062 and 4,488,470 were granted to Butler, Thoman and Larrain respectively. While these patents taught frictional devices which helped prevent drum sticks from slipping out of the drummer's fingers, they did not provide locational guidance for the drummers grip. In addition, no rings were taught which substantially add to the drum stick radius, thus preventing these designs from increasing the moment available to the drummer to help reduce drummer fatigue.

U.S. Pat. Nos. 5,581,031, 5,370,030 and 3,365,108 granted Blankenship, Jr., Home and Giba taught rings through which the drummer could insert one or more fingers in order to prevent the drum stick from flying out of his hand. U.S. Pat. No. 2,905,043 granted to Soderberg taught a pair of hingedly attached bass drum sticks, one of which featured a ball attached to a drum stick by means of a post.

While the Home '030 and Giba '108 designs taught means for preventing the drum sticks from slipping out of the drummer's hand, no rings were taught which substantially add to the drum stick radius, thus preventing these designs from increasing the moment available to the drummer to help reduce drummer fatigue.

While the Blankenship '031 pistol grip design appeared to increase the grip of the drummer on the drum stick, the design rendered the stick difficult to grip using the traditional grip. In addition, the grip was pre-sized, thus preventing adjustability for different hand sizes.

Similarly, although the Soderberg '043 post ball increased the moment arm available to the drummer when the post ball was pushed with the thumb, this design appears inappropriate for use in the traditional or match-grip style.

U.S. Pat. Nos. 5,400,685 and 5,260,506 granted Cappella, and U.S. Pat. No. 5,361,671 granted Genna, taught drum stick bead rings. While these rings extended circumferentially around the bead, they did not aid in drummer grip nor drummer grip location on the drum stick.

SUMMARY OF THE INVENTION

Accordingly, it is an object of the present invention to provide ergonomic rings for drum sticks and methods which permit the drum sticks to be played by means of a simple push-pull motion by the drummer's thumb and fingers. Design features allowing this object to be accomplished include at least one ergonomic ring frictionally engaged with a drum stick shaft. Advantages associated with the accomplishment of this object include increased control and speed of play.

It is another object of the present invention to provide ergonomic rings for drum sticks and methods which maintain the drummer's hands in the correct position on the drum stick. Design features allowing this object to be accomplished include at least one ergonomic ring frictionally engaged with a drum stick shaft positioned so as to guide the drummer's hand into position. A benefit associated with the accomplishment of this object is more accurate drum stick holding by the drummer.

It is still another object of this invention to provide ergonomic rings for drum sticks and methods which are adjustable for personal preference. Design features enabling the accomplishment of this object include at least one ergonomic ring frictionally engaged with a drum stick shaft. Advantages associated with the realization of this object include the ability to use the instant ergonomic rings with a wide variety of drummer hand sizes, and the cost savings associated with such standardization.

It is another object of the present invention to provide ergonomic rings for drum sticks and methods which help prevent a drum stick from slipping out of a drummer's hand. Design features allowing this object to be accomplished include at least one ergonomic ring frictionally engaged with a drum stick shaft. Benefits associated with the accomplishment of this object include decreased drum stick loss, associated enhanced performance quality, and reduced drummer fatigue.

It is another object of the present invention to provide ergonomic rings for drum sticks and methods which may be used with either the traditional or the match-grip style, and either left or right hand use. Design features allowing this object to be accomplished include at least one ergonomic ring frictionally engaged with a drum stick shaft. Benefits associated with the accomplishment of this object include increased installation versatility, and hence decreased cost.

It is still another object of this invention to provide ergonomic rings for drum sticks which may be installed on a new drum stick when the drum stick upon which the ergonomic ring was originally installed wears out. Design features enabling the accomplishment of this object include at least one ergonomic ring manufactured of resilient material, sized to frictionally and removably engage with a drum stick shaft. Advantages associated with the realization of this object include increased flexibility of use, and reduced cost.

It is yet another object of this invention to provide ergonomic rings for drum sticks which are inexpensive to manufacture. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawing.

Eight sheets of drawings are provided. Sheet one contains FIGS. 1 and 2. Sheet two contains FIGS. 3 and 4. Sheet three contains FIGS. 5–8. Sheet four contains FIGS. 9 and 10. Sheet five contains FIGS. 11 and 12. Sheet six contains FIGS. 13 and 14. Sheet seven contains FIGS. 15–17. Sheet eight contains FIG. 18.

DETAILED DESCRIPTION OF THE PREFERRED EMBODIMENT

Figure 1:
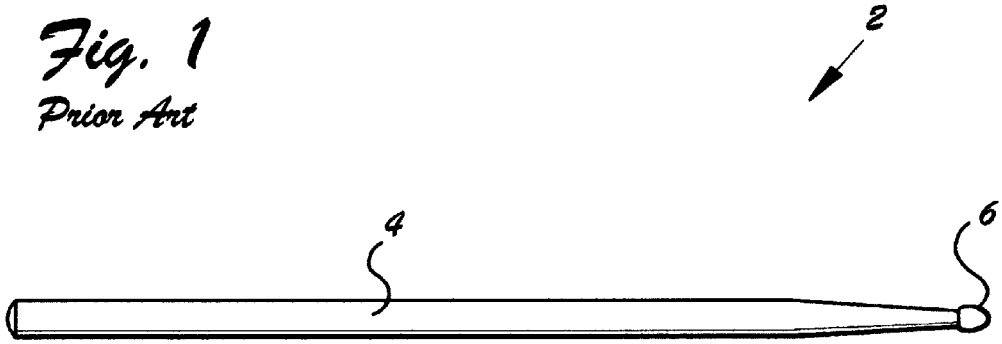
Fig. 1 Prior Art
FIG. 1 is a side isometric view of a prior art drum stick.
Figure 2:
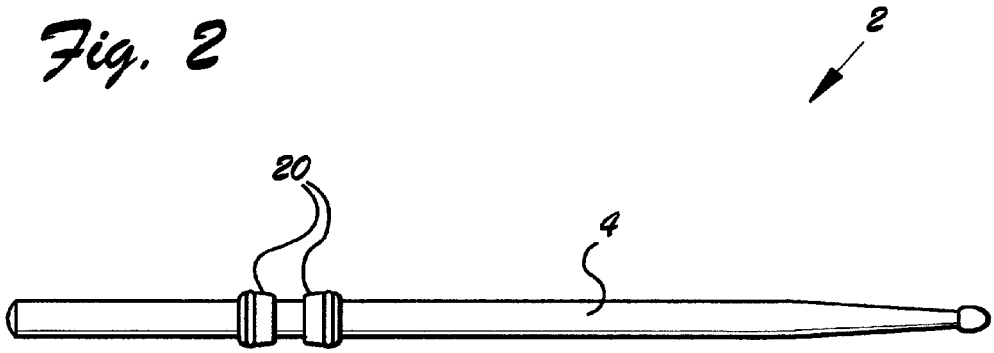
FIG. 2 is a side isometric view of a drum stick with a pair of ergonomic rings installed.

Referring now to FIG. 2, we observe a side isometric view of drum stick 2 with a pair of ergonomic rings 20 installed on its shaft 4. As may be observed in FIG. 3, a side quarter isometric view of ergonomic ring 20, ergonomic ring 20 comprises ergonomic ring bore 22. Ergonomic ring bore 22 is sized to frictionally admit shaft 4.

In addition, in the preferred embodiment, ergonomic ring 20 was manufactured of resilient material such as rubber. Thus, ergonomic ring 20 is capable of stretching to admit shaft 4. Once ergonomic ring 20 has been installed on shaft 20, its inherent resilience causes it to tightly grip shaft 4, thus maintaining its position in a desired location on shaft 4.

Figure 4:
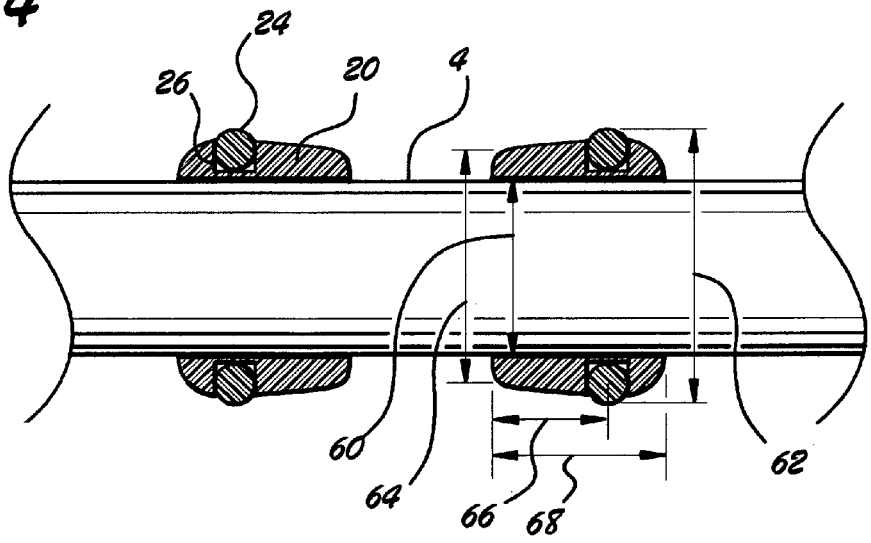
FIG. 4 is a side cross-sectional view of a pair of ergonomic rings installed on a drum stick.

FIG. 4 is a side cross-sectional view of a pair of ergonomic rings 20 installed on a drum stick shaft 4. In the preferred embodiment, ergonomic ring 20 incorporated ergonomic ring groove 26 around its outer surface. Ergonomic ring groove 26 is sized to admit O-ring 24. O-ring 24 serves to provide enhanced frictional area and contour with which a drummer may grip an ergonomic ring 20, and also serves to increase the radius of ergonomic ring 20. Ergonomic ring tapered end 28 is disposed at an extreme of ergonomic ring 20 opposite O-ring 24. An outside diameter of ergonomic ring 20 diminishes from O-ring 24 to ergonomic ring tapered end 28.

As may be observed in FIG. 4, ergonomic rings 20 are ideally spaced apart a distance substantially equal to the width of the drummer's middle finger. For most drummers, this distance is equal to approximately 0.75±0.25 inches.

The optimum shape of ergonomic rings was determined experimentally. Thus, in the preferred embodiment, the ratio of O-ring diameter 62 to ergonomic ring bore diameter 60 was 1.64±0.25, the ratio of ergonomic ring outside diameter 64 at ergonomic ring tapered end 28 to ergonomic ring bore diameter 60 was 1.36±0.25, the ratio of ergonomic ring length 68 to ergonomic ring bore diameter 60 was 1.00±0.25, and the ratio of O-ring distance 66 to ergonomic ring bore diameter 60 was 0.68±0.25. O-ring distance 66 is the distance along the length of ergonomic ring 20 from the center of O-ring 24 to ergonomic ring tapered end 28. It is within the scope of this disclosure that O-ring 24 and the remainder of ergonomic ring 20 be of integral construction.

Figure 5:
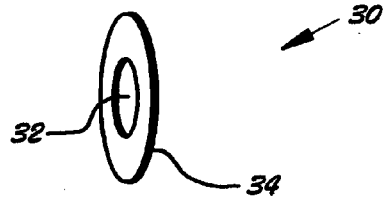
Fig. 5 Prior Art
FIG. 5 is a side quarter isometric view of a washer.
Figure 6:
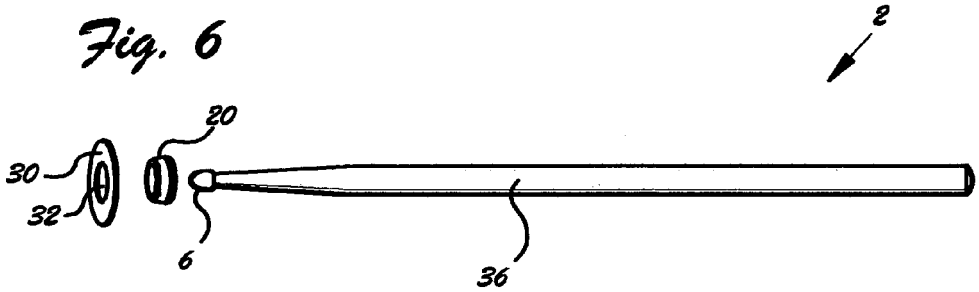
FIGS. 6–8 depict an ergonomic ring being installed on a drum stick using a washer installation tool.
Figure 7:
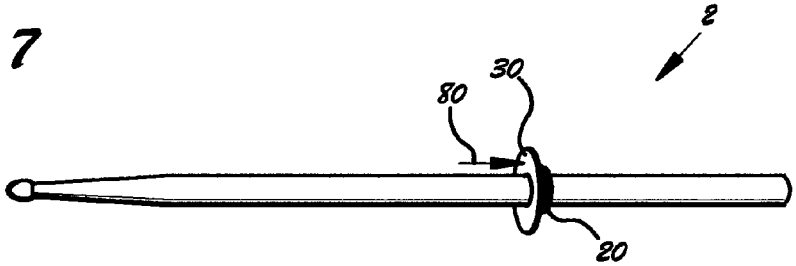
Figure 8:
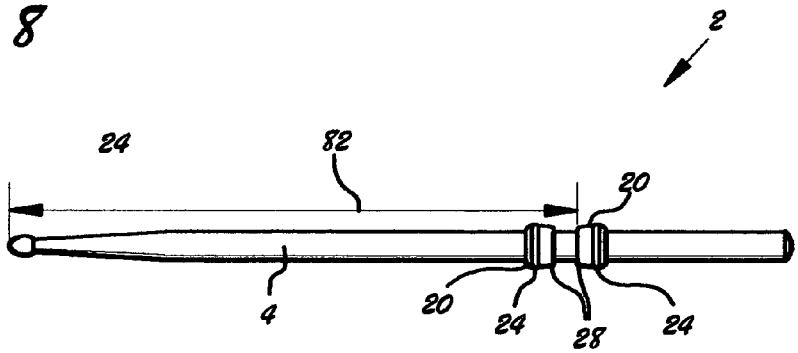

FIGS. 5–10 depict apparatus and methods of installation of ergonomic rings 20 on a drum stick 2. FIG. 5 is a side quarter isometric view of washer 30. Washer 30 comprises washer bore 32 sized to admit drum stick 2. In addition, washer 30 comprises washer outside diameter 34, sized sufficiently large to permit a drummer to push ergonomic ring 20 onto drum stick 2 as depicted in FIGS. 6–8. In the preferred embodiment, two or more washers 30 with different washer bore 32 sizes were provided with each package of ergonomic rings 20 to accommodate different sizes of drum sticks.

Ergonomic ring 20 is installed on drum stick 2 by first applying lubricant 36 to drum stick 2 as shown in FIG. 6. In the preferred embodiment, lubricant 36 was a commercially available lubricant such as K-Y Jelly, which dries cleanly, with no residue. Next, an extreme of drum stick 2 is inserted into ergonomic ring bore 22, as illustrated in FIG. 6. Although either extreme of drum stick 2 may be inserted into ergonomic ring bore 22, it is generally easiest to insert the end of drum stick 2 which terminates in bead 6.

Next, the same end of drum stick 2 is inserted into washer bore 32 as depicted in FIG. 7. Washer 30 is then used to push ergonomic ring 20 into a desired position on drum stick 2 as indicated by arrow 80 in FIG. 7. In the preferred embodiment, the correct location of the first installed ergonomic ring 20 is such that its ergonomic ring tapered end 28 is substantially two-thirds the length of drum stick 2 from the bead end of drum stick 2, and its O-ring 24 is further removed from bead 6 than its ergonomic ring tapered end 28. This position is illustrated by first ergonomic ring installed length 82 in FIG. 8.

A second ergonomic ring 20 is then installed on drum stick 2 in the same fashion as the first ergonomic ring 20, but with its O-ring 24 closer to bead 6 than its ergonomic ring tapered end 28. In the preferred embodiment, ergonomic rings 20 were installed such that a distance between their respective tapered ends 28 was substantially equal to the width of the drummer's middle finger. Typically the width of a drummer's middle finger is 0.75±0.25 inches.

Figure 18:
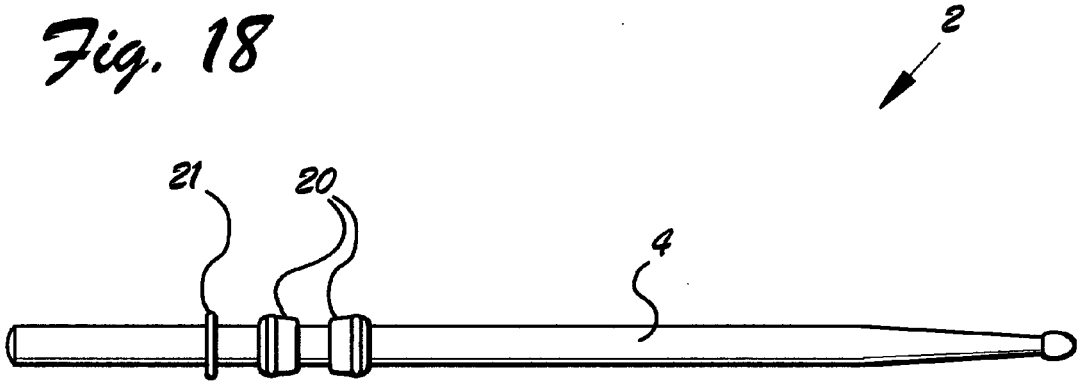
FIG. 18 is a side isometric view of an alternate embodiment ergonomic ring and installation.

If a third ergonomic ring 20 or alternate embodiment ergonomic ring 21 is to be installed, as is illustrated in FIG. 18, it may be installed on drum stick 2 in the same fashion as the first ergonomic ring 20 as described above. Such third ergonomic ring 20 or 21 may be installed such that a distance between the first ergonomic ring 20 and the third ergonomic ring 20 or 21 is substantially equal to the width of the drummer's ring finger. Typically the width of a drummer's ring finger is 0.75±0.25 inches.

Figure 3:
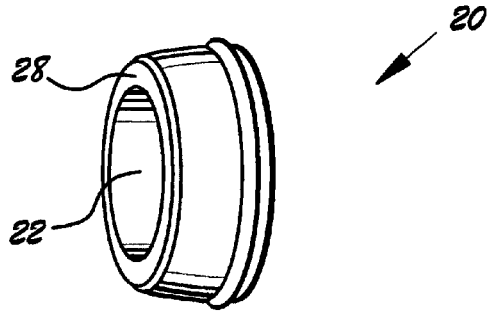
FIG. 3 is a side quarter isometric view of an ergonomic ring.

FIG. 18 depicts an alternate embodiment ergonomic ring 21 installed as a third ring, as described above. In this embodiment, the drummer would hold the drum stick 2 same as previously described for two ergonomic rings 20, except the drummer's ring finger would be disposed between the first ergonomic ring 20 and the alternate embodiment ergonomic ring 21. Use of the three-ring embodiment is same as use of the two-ring embodiment, except the drummer's ring finger would be disposed between the first ergonomic ring 20 and the alternate embodiment ergonomic ring 21. The alternate embodiment ergonomic ring may be a simple O-ring as depicted in FIG. 18, or an ergonomic ring 20 as is depicted in FIGS. 2–4.

Figure 9:
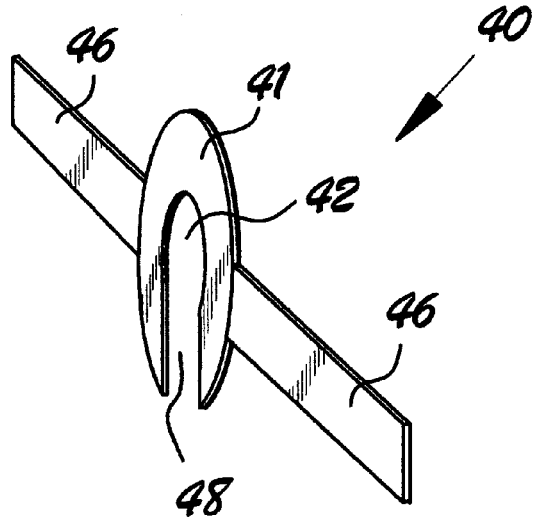
FIG. 9 is a side quarter isometric view of a winged washer.

FIG. 9 is a side quarter isometric view of winged washer 40, which is an alternate embodiment installation tool to aid in the installation of ergonomic rings 20 and/or 21 on drum stick 2. Winged washer 40 comprises a pair of wings 46 rigidly attached to opposite sides of slotted washer 41. Slotted washer 41 comprises winged washer bore 42 communicating with winged washer slot 48. Winged washer bore 42 and winged washer slot 48 are sized to slidably admit drum stick shaft 4.

In practice, drum stick shaft 4 is inserted into winged washer bore 42, either directly or through winged washer slot 48. Wings 46 are then used to push ergonomic ring 20 and/or 21 into a desired location along shaft 4.

Figure 10:
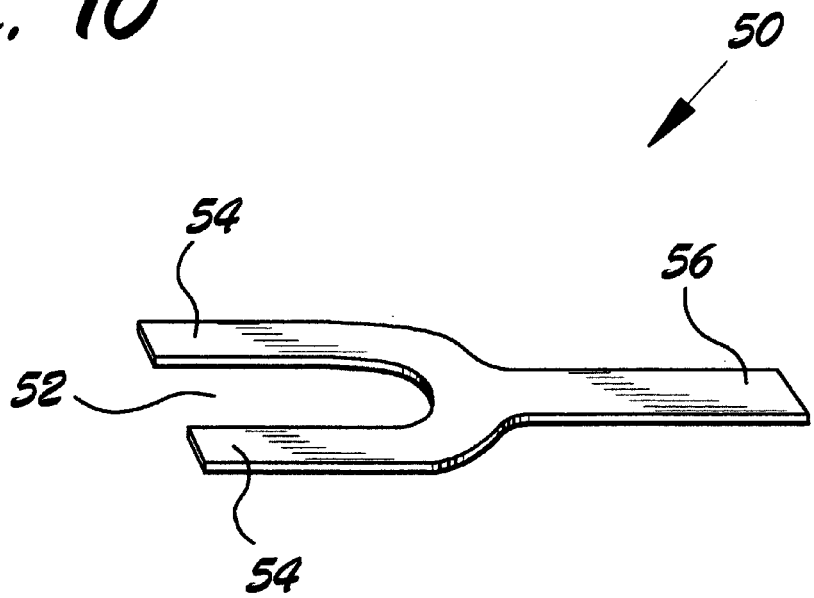
FIG. 10 is a side elevated isometric view of an installation fork.

FIG. 10 is a side elevated isometric view of installation fork 50, which is an alternate embodiment installation tool to aid in the installation of ergonomic rings 20 and/or 21 on drum stick 2. Installation fork 50 comprises a pair of installation fork tangs 54 rigidly attached to installation fork handle 56. Installation fork tangs 54 are mutually separated by installation fork slot 52. Installation fork slot 52 is sized to slidably admit drum stick shaft 4.

In practice, drum stick shaft 4 is inserted into installation fork slot 52. Installation fork handle 56 is then used to push ergonomic ring 20 and/or 21 into a desired location along shaft 4.

Figure 11:
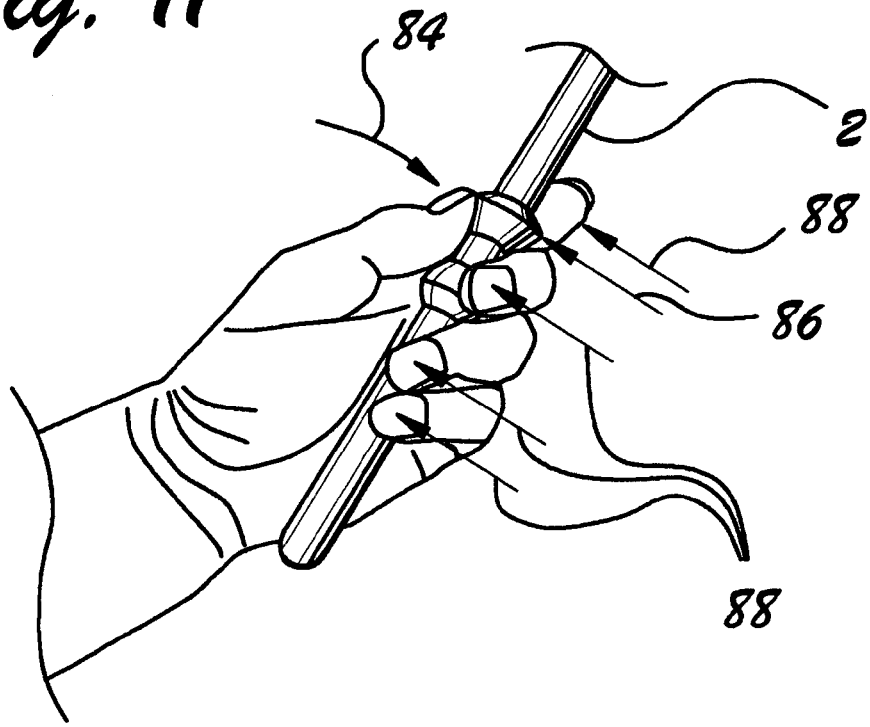
FIG. 11 depicts a drummer holding a drum stick with ergonomic rings in his left hand using a match-grip.

FIG. 11 depicts a drummer holding a drum stick 2 with ergonomic rings 20 in his left hand using a match-grip. The drummer's middle finger is disposed between ergonomic rings 20. The drummer's index finger is disposed on the drum stick bead side of ergonomic rings 20, and the drummer's third and fourth fingers are disposed on the side of ergonomic rings 20 opposite his index finger.

In this position, the drum stick is played by pushing with the thumb as indicated by arrow 84 and pulling with the fingers as indicated by arrows 88, using the ergonomic ring 20 nearest bead 6 as a fulcrum against the index finger as indicated by arrow 86. As may be observed in FIGS. 15–17, ergonomic ring 20 has the effect of increasing the length of drum stick radius 72, thus increasing the moment arm available to the drummer and reducing the force required to play, thereby decreasing drummer effort and fatigue.

Figure 12:
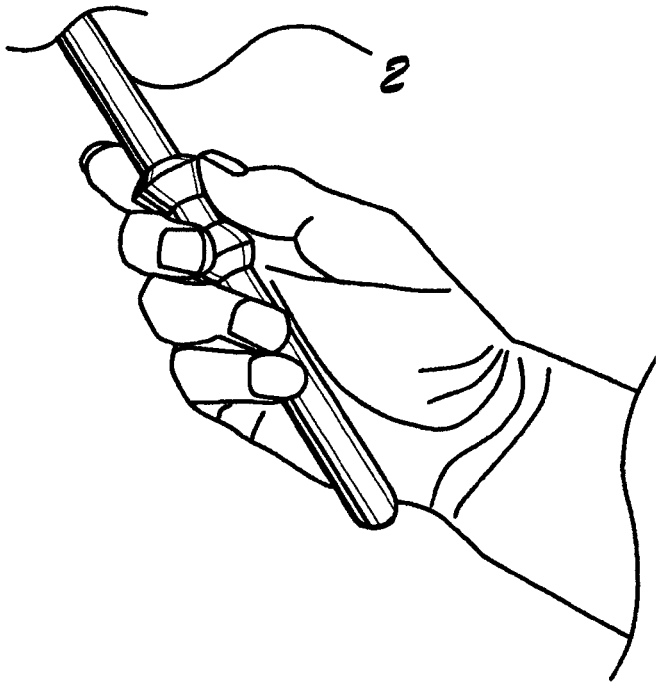
FIG. 12 depicts a drummer holding a drum stick with ergonomic rings in his right hand using a match-grip.

FIG. 12 depicts a drummer holding a drum stick 2 with ergonomic rings 20 in his right hand using a match-grip. The drummer's middle finger is disposed between ergonomic rings 20. The drummer's index finger is disposed on the drum stick bead side of ergonomic rings 20, and the drummer's third and fourth fingers are disposed on the side of ergonomic rings 20 opposite his index finger.

In this position, the drum stick is played by pushing with the thumb and pulling with the fingers, using the ergonomic ring 20 nearest bead 6 as a fulcrum against the index finger. As may be observed in FIGS. 15–17, ergonomic ring 20 has the effect of increasing the length of drum stick radius 72, thus increasing the moment arm available to the drummer and reducing the force required to play, thereby decreasing drummer effort and fatigue.

Figure 13:
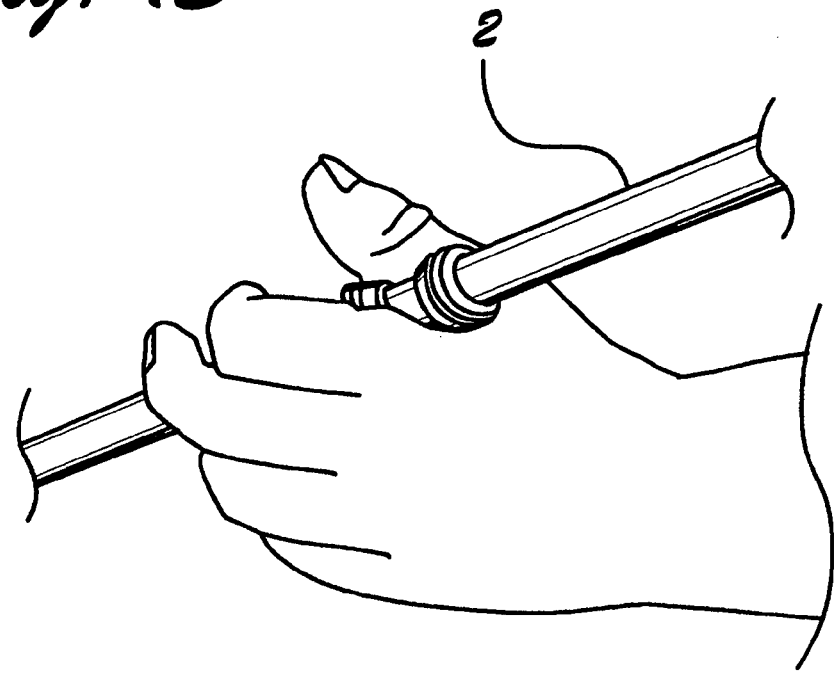
FIG. 13 depicts a drummer holding a drum stick with ergonomic rings in his left hand using the traditional grip.

FIG. 13 depicts a drum stick 2 with ergonomic rings 20 being held in a drummer's left hand using the traditional grip. The crook between the drummer's thumb and index finger is disposed between ergonomic rings 20. Ergonomic rings 20 ensure the drummer's hand is correctly located along the length of drum stick 2. In this position, drum stick 2 is played in conventional fashion, and ergonomic rings 20 aid in placing the drummer's hand correctly along the length of drum stick 2.

Figure 14:
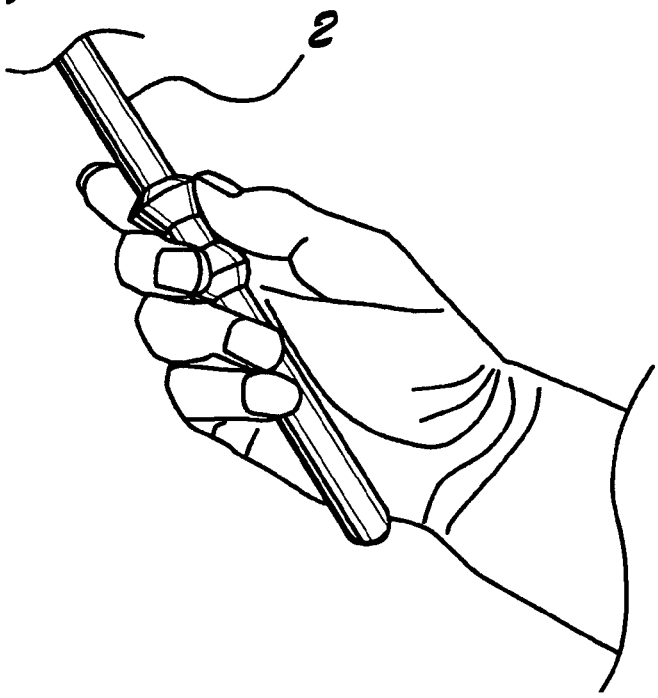
FIG. 14 depicts a drummer holding a drum stick with ergonomic rings in his left hand using the traditional grip, which is the same as the match-grip for the right hand.

FIG. 14 depicts a drummer holding a drum stick 2 with ergonomic rings 20 in his right hand using a match-grip. The drummer's middle finger is disposed between ergonomic rings 20. The drummer's index finger is disposed on the drum stick bead side of ergonomic rings 20, and the drummer's third and fourth fingers are disposed on the side of ergonomic rings 20 opposite his index finger.

In this position, the drum stick is played by pushing with the thumb and pulling with the fingers, using the ergonomic ring 20 nearest bead 6 as a fulcrum against the index finger. As may be observed in FIGS. 15–17, ergonomic ring 20 has the effect of increasing the length of drum stick radius 72, thus increasing the moment arm available to the drummer and reducing the force required to play, thereby decreasing drummer effort and fatigue.

When a drummer is holding drum stick 2 in the positions illustrated in FIGS. 11, 12 and 14, with his middle finger between ergonomic rings 20, he plays drum stick 2 by pushing with his thumb, and pulling with his fingers, as previously noted. More specifically, the drummer's index finger is disposed against the ergonomic ring 20 closest bead 6. The drummer's thumb is disposed against the ergonomic ring 20 closest bead 6 diametrically opposed from the drummer's index finger. The drummer's middle finger is disposed between the ergonomic rings 20 diametrically opposite the drummer's thumb, and the drummer's third and fourth fingers are disposed on the side of the ergonomic rings 20 farther from bead 6, their second and third joints being disposed diametrically opposite the drummer's thumb.

Thus, the drummer's index finger serves as a fulcrum against the ergonomic ring 20 closest bead 6. The action of the drummer pushing with his thumb on that same ring at a location diametrically opposed his index finger, while simultaneously pulling with his index, middle, third and fourth fingers, has the effect of pivoting the drum stick 2 around the fulcrum which is the drummer's middle finger.

Figure 15:
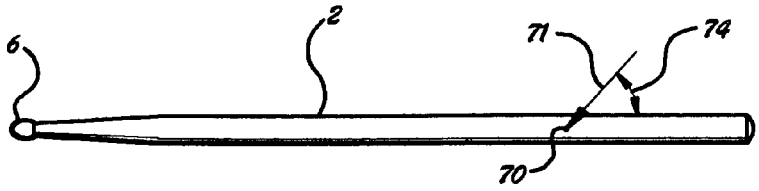
Fig. 15 Prior Art
FIGS. 15–17 illustrate the geometrical advantage of the instant invention over the prior art drum sticks due to the greater radius inherent in the instant ergonomic rings compared to the smaller radius of a prior art drum stick.
Figure 16:
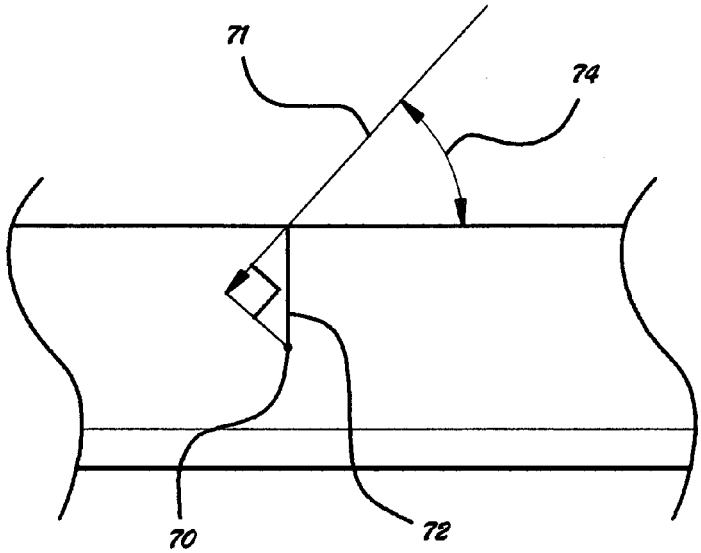
Fig. 16 Prior Art
Figure 17:
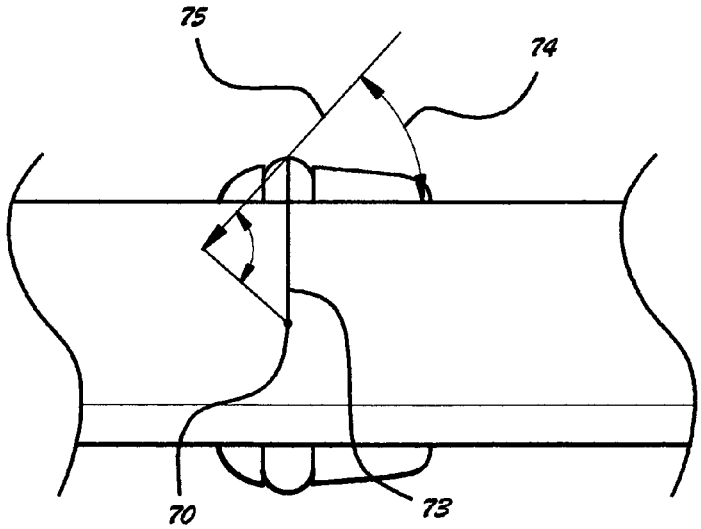

FIGS. 15–17 illustrate the geometrical advantage of the instant invention over the prior art drum sticks due to the greater radius inherent in the instant ergonomic rings compared to the radius of a prior art drum stick.

Played conventionally, a drummer exerts drum stick force 71 on drum stick 2 at a force angle 74 as illustrated in FIG. 15. As a result, drum stick 2 rotates about pivot point 70, and bead 6 strikes the drum head. Referring now to FIG. 16, for a given drum stick radius 72, the moment required to obtain this result=(drum stick force 71)×(drum stick radius 72)×(cosine of force angle 74).

In order to obtain the same result using the instant ergonomic rings 20, we may refer to FIG. 17. The moment required is the same, and equals (ergonomic ring force 75)×(ergonomic ring radius 73)×(cos force angle 74). Note, however, that ergonomic ring radius 73 is larger than drum stick radius 72; therefore the ergonomic ring force 75 required to obtain the same moment is proportionally less.

Expressed Trigonometrically:

(ergonomic ring force 75)×(ergonomic ring radius 73)×(cos force angle 74)=(drum stick force 71)×(drum stick radius 72)×(cosine of force angle 74)

Simplified:

(ergonomic ring force 75)×(ergonomic ring radius 73)=(drum stick force 71)×(drum stick radius 72)

And, solving for ergonomic ring force 75:

(ergonomic ring force 75)=[(drum stick force 71)×(drum stick radius 72)]/(ergonomic ring radius 73)

In the preferred embodiment the ratio of drum stick radius 72 to ergonomic ring radius 62 was 0.61. Thus, in the preferred embodiment:

ergonomic ring force 75=0.61×(drum stick force 71)

Therefore, in the preferred embodiment, the force required of the drummer to play the instant drum stick 2 equipped with ergonomic rings 20 was only 61% the force required to play the same drum stick 2 without ergonomic rings 20! Given the dramatically reduced force required to play the instant drum stick 2 with ergonomic rings 20, the reduction in drummer fatigue is substantial. In addition, the enhanced level of drummer comfort and ability to play faster and stronger are added benefits inherent in the use of the instant ergonomic rings 20.

While a preferred embodiment of the invention has been illustrated herein, it is to be understood that changes and variations may be made by those skilled in the art without departing from the spirit of the appending claims.

DRAWING ITEM INDEX

2 drum stick
4 shaft
6 bead
20 ergonomic ring
21 alternate embodiment ergonomic ring
22 ergonomic ring bore
24 O-ring
26 ergonomic ring groove
28 ergonomic ring tapered end
30 washer
32 washer bore
34 washer outside diameter
36 lubricant
40 winged washer
41 slotted washer
42 winged washer bore
46 wing
48 winged washer slot
50 installation fork
52 installation fork slot
54 installation fork tang
56 installation fork handle
60 ergonomic ring bore diameter
62 O-ring diameter
64 ergonomic ring outside diameter
66 O-ring distance
68 ergonomic ring length
70 pivot point
71 drum stick force
72 drum stick radius
73 ergonomic ring radius
74 force angle
75 ergonomic ring force
80 arrow
82 first ergonomic ring installed length
84 arrow
86 arrow
88 arrow

I claim:

1. A method of use for a drum stick with two ergonomic rings using a match-grip, said drum stick comprising a bead at one end, a first said ergonomic ring being installed substantially two-thirds of the way from a drum stick bead end to an end of said drum stick opposite said bead, a second said ergonomic ring being installed substantially the width of a drummer's middle finger away from said first ergonomic ring towards said bead, the method of use comprising the steps of:

A. Gripping said drum stick with a drummer's index finger disposed against said second ergonomic ring, with said drummer's thumb disposed against said second ergonomic ring diametrically opposed from said drummer's index finger, with said drummer's middle finger disposed between said ergonomic rings diametrically opposite said drummer's thumb, and with said drummer's third and fourth fingers disposed on a side of said ergonomic rings farther from said bead, their second and third joints being disposed diametrically opposite the drummer's thumb, and B. Pushing with said drummer's thumb on said second ergonomic ring at a location diametrically opposed said drummer's index finger, while simultaneously pulling with said drummer's index, middle, third and fourth fingers, whereby said drummer's index finger serves as a fulcrum against said second ergonomic ring, and said drum stick is pivoted around the fulcrum which is the drummer's middle finger.

2. A method of use for a drum stick with two ergonomic rings using a traditional grip, said drum stick comprising a bead at one end, a first said ergonomic ring being installed substantially two-thirds of the way from a drum stick bead end to an end of said drum stick opposite said bead, a second said ergonomic ring being installed substantially the width of a drummer's middle finger away from said first ergonomic ring towards said bead, the method of use comprising the steps of A. Gripping said drum stick with a crook between a drummer's thumb and index finger being disposed between said ergonomic rings, whereby said ergonomic rings aid in placing said drummer's hand correctly along a length of said drum stick.

* * * * *